US005345644A

United States Patent [19]

Gueret

[11] Patent Number: 5,345,644

[45] Date of Patent: Sep. 13, 1994

[54] BRUSH INTENDED FOR THE APPLICATION OF A COSMETIC PRODUCT, IN PARTICULAR TO THE EYELASHES OR THE HAIR

[75] Inventor: Jean-Louis Gueret, Paris, France

[73] Assignee: L'Oreal, Paris, France

[21] Appl. No.: 36,856

[22] Filed: Mar. 25, 1993

[30] Foreign Application Priority Data

Apr. 27, 1992 [FR] France ..... 92 05146

[51] Int. Cl.[5] ..... A46B 3/18

[52] U.S. Cl. ..... 15/160; 15/206; 15/207.2; 15/DIG. 5; 15/DIG. 6; 132/218; 132/317; 132/320

[58] Field of Search ..... 15/160, 206, 207.2, 15/DIG. 5, DIG. 6; 132/218, 317, 320

[56] References Cited

U.S. PATENT DOCUMENTS

| | | | |
|---|---|---|---|
| 4,586,520 | 5/1986 | Brittain | 132/218 |
| 4,861,179 | 8/1989 | Schrepf et al. | 15/206 |
| 4,887,622 | 12/1989 | Gueret | 132/320 |
| 4,927,281 | 5/1990 | Gueret | 15/206 |
| 5,020,551 | 6/1991 | Gueret | 15/207.2 |

FOREIGN PATENT DOCUMENTS

| | | | |
|---|---|---|---|
| 0438935 | 7/1991 | European Pat. Off. . | |
| 3433763 | 2/1986 | Fed. Rep. of Germany . | |
| 2607372 | 6/1988 | France . | |
| 2637472 | 4/1990 | France . | |
| 2198337 | 6/1988 | United Kingdom . | |
| 2224641 | 5/1990 | United Kingdom | 15/160 |
| 2225225 | 5/1990 | United Kingdom . | |

*Primary Examiner*—Timothy F. Simone
*Assistant Examiner*—Mark Spisich
*Attorney, Agent, or Firm*—Cushman, Darby & Cushman

[57] ABSTRACT

A brush intended for the application of a cosmetic product comprises a plurality of bristles (3, 4) transversely implanted in a core. These bristles are formed by a mixture of bristles selected from at least two groups, namely a first group consisting of bristles (3) of relatively small section and a second group of bristles (4) of larger section. The bristles of small section (3) are made of a thermoplastic having a higher melting point than the melting point of the thermoplastic elastomer from which the bristles (4) of larger section are made. The melting point of the thermoplastic of the bristles of small section is of the order of 230° to 280° C., while the melting point of the thermoplastic elastomer of the bristles of larger section is of the order of 150° to 230° C.

8 Claims, 2 Drawing Sheets

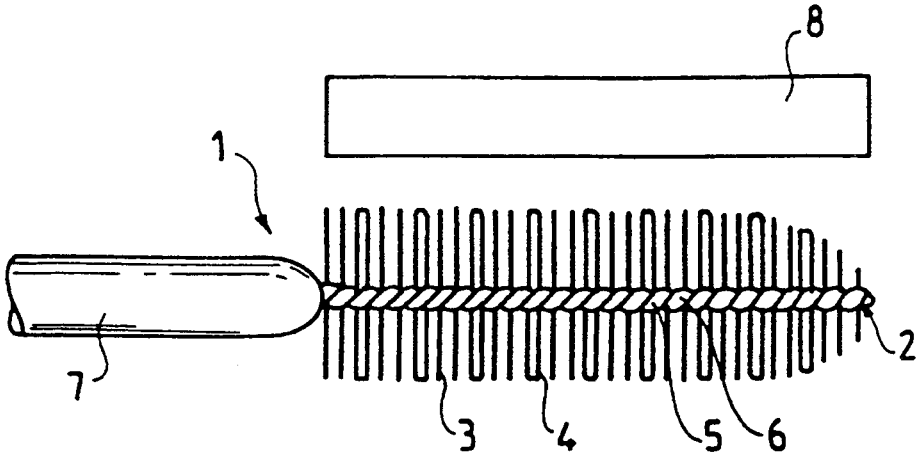
FIG. 1
FIG. 2
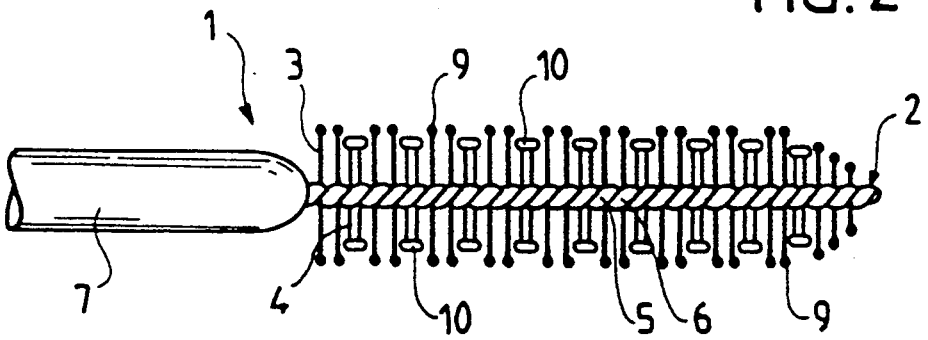
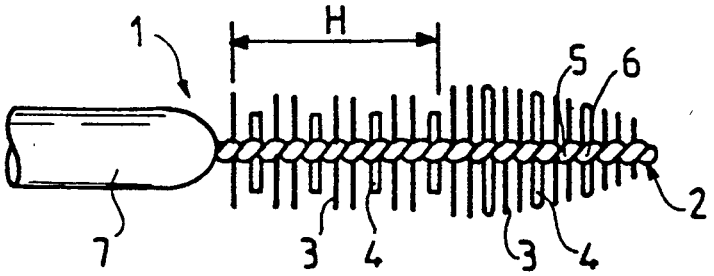
FIG. 3
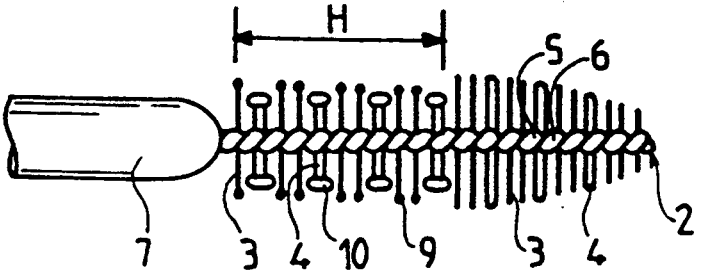
FIG. 4

BRUSH INTENDED FOR THE APPLICATION OF A COSMETIC PRODUCT, IN PARTICULAR TO THE EYELASHES OR THE HAIR

FIELD OF THE INVENTION

The invention relates to a brush intended for the application of a cosmetic product, in particular to the eyelashes or the hair, of the type comprising a plurality of bristles transversely implanted in a core, in particular formed by turns of a twisted metal wire, turns between which the bristles are wedged, these bristles being formed by a mixture of bristles selected from at least two groups, namely, a first group consisting of bristles of relatively small section, in particular inscribed in a circle having a diameter of between 6 and 13 hundredths of a millimeter, and a second group of bristles of larger section, in particular inscribed in a circle having a diameter larger than 13 hundredths of a millimeter and generally smaller than 30 hundredths of a millimeter, the bristles of small section having a greater length in the radial direction than the bristles of large section, over at least part of the brush.

BACKGROUND OF THE INVENTION

FR-A--2 637 472 shows a brush of this type by means of which it is possible both to take up an appropriate quantity of product to apply it to the eyelashes and to comb and smooth the eyelashes.

Although brushes of this type are on the whole satisfactory, they do not allow for make-up effects which are truly different from those obtained with conventional brushes.

SUMMARY OF THE INVENTION

The aim of the invention is above all to provide a brush for obtaining strong, distinct make-up effects different from those obtained hitherto.

Another aim of the invention is to provide a brush still at a reasonable price and to propose a simple process for the manufacture of a brush of this kind.

According to the invention, a brush intended for the application of a cosmetic product, in particular to the eyelashes or the hair, of the type defined hereinbefore is characterised in that the bristles of small section are made of a thermoplastic having a higher melting point than the melting point of the thermoplastic elastomer from which the bristles of larger section are made, the melting point of the thermoplastic of the bristles of small section being of the order of 230° to 280° C., while the melting point of the thermoplastic elastomer of the bristles of larger section is of the order of 150° to 230° C. The difference between these melting points is preferably of the order of 50° C.

The ends of the bristles of small section and the ends of the bristles of large section advantageously display a bulge.

The bulge at the ends of the bristles of small section is preferably in the shape of a small ball, while the bulge situated at the ends of the bristles of larger section has a flatter shape with a larger diameter, in the shape of a mushroom head.

The number of bristles per turn is advantageously between 7 and 55.

The proportion of bristles of large section relative to the bristles of small section is preferably between $\frac{1}{4}$ and 4/1.

The bristles of small section can be made of nylon or polyester, while the bristles of larger section are made of a relatively soft thermoplastic or of a soft thermoplastic elastomer such as EPDM rubbers, polyesters or polyether block amides.

The bristles of smaller section generally have a circular section which may be solid or hollow, or they may have at least one capillary groove, as provided by FR-A-2 607 372.

A specific make-up effect can be achieved with a brush according to the invention.

The invention also relates to a process for the manufacture of a brush intended for the application of a cosmetic product, in particular to the eyelashes or the hair, comprising a plurality of bristles transversely implanted in a core, in particular formed by turns of a twisted metal wire, turns between which the bristles are wedged, these bristles being formed by a mixture of bristles selected from at least two groups, namely a first group consisting of bristles of relatively small cross-section, in particular inscribed in a circle having a diameter of between 6 and 13 hundredths of a millimeter, and a second group of bristles of larger cross-section, in particular inscribed in a circle having a diameter larger than 13 hundredths of a millimeter and generally smaller than 30 hundredths of a millimeter, the bristles of small cross-section having a greater length in the radial direction than the bristles of large cross-section, over at least part of the brush, the process being characterised in that the bristles of small cross-section are made of a plastic having a higher melting point than the melting point of the plastic from which the bristles of larger cross-section are made, that a model brush is made with bristles of small cross-section and of larger cross-section having similar lengths, and that the brush is then subjected to heat treatment over at least part of its length, resulting in a greater reduction in length for the bristles of large cross-section than for the bristles of small cross-section.

The heat treatment can be effected with hot air, in which case the ends of the bristles do not display a bulge after heat treatment.

According to another advantageous possibility, the heat treatment is effected with a heat source consisting of a flame or infrared heating, the two types of bristles having ends provided with a bulge following this heat treatment.

The heat source can extend in a direction parallel to the core of the brush at an appropriate distance and the brush is subjected to a rotational movement about the axis of the core in order to ensure substantially homogeneous heating along the entire periphery.

The melting point of the plastic of the bristles of small section is preferably of the order of 230° to 280° C., while the melting point of the plastic of the bristles of larger section is of the order of 150° to 230° C.

In addition to the arrangements described hereinabove, the invention consists of a number of other arrangements which will be discussed in more detail hereinafter by way of one nonlimiting embodiment described with reference to the accompanying drawings, in which:

BRIEF DESCRIPTION OF THE DRAWINGS

FIG. 1 is a diagram showing one stage of the process for the manufacture of a brush according to the invention;

FIG. 2 is a diagram of a brush according to the invention;

FIG. 3 shows a variant embodiment of a brush according to the invention, and finally FIG. 4 shows another variant embodiment.

DETAILED DESCRIPTION OF THE INVENTION

Figure 5A:
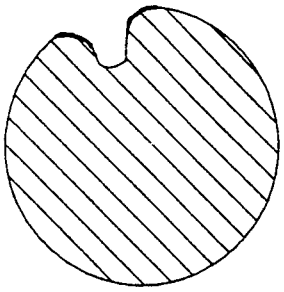
FIGS. 5*a*, 5*b* and 5*c* show variants of the cross-sectional shape of the bristle of the present invention.

Referring to FIG. 1 of the drawings, it shows one stage of the manufacture of a brush 1 for the application of a cosmetic product, in particular mascara, to the eyelashes. The brush 1 comprises a metal core 2 formed by an iron wire folded to form a U. The bristles 3, 4 are introduced transversely to the longitudinal direction of the core between the parallel branches of the iron wire. The iron wire folded to form a U is then twisted so that the bristles 3, 4 are wedged between the turns 5, 6 of the metal wire. The core 2 produced in this manner is fixed to the end of a stem 7 of larger diameter.

The bristles 3 and 4 are formed by a mixture of bristles selected from at least two groups, namely a first group consisting of bristles 3 of relatively small section and a second group of bristles 4 of larger section.

Figure 5B:
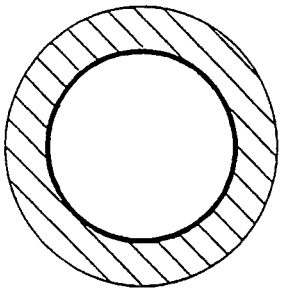
Figure 5C:
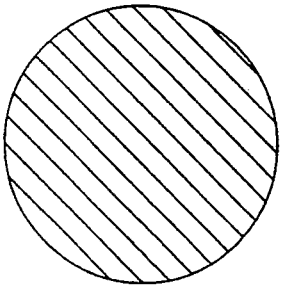

The bristles 3 preferably have a section which is inscribed in a circle the diameter of which is between 6 and 13 hundredths of a millimeter. The section of the bristles may be solid or hollow circular or may have at least one capillary groove, as in FR-A--2 607 372, and as shown in FIGS. 5*a*, 5*b*, and 5*c*, respectively.

Figure 6:
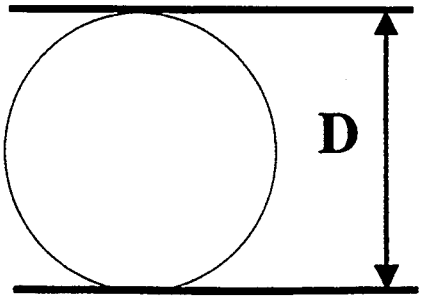
FIG. 6 is an illustration of a the diameter measurement for the cross-section of the bristle of the present invention.

The bristles 4 have a section the contour of which is included between a circle the diameter of which is larger than 13 hundredths of a millimeter and a circle the diameter of which is generally smaller than 30 hundredths of a millimeter, the diameter D being measured as shown between the lines of FIG. 6.

The number of bristles 3, 4 per turn of the core 2 is between 7 and 55, preferably between 10 and 40. For the sake of clarity, the representation of FIGS. 1 and 2 obviously does not show this number of bristles.

The proportion of bristles 4 of large section relative to the bristles 3 of small section is advantageously between ¼ and 4/1.

At the stage of manufacture shown in FIG. 1, the bristles 3 and 4 have substantially the same radial length, and the general shape of the brush is produced in a conventional manner with the aid of shears.

The bristles 3 are made of a plastic having a higher melting point than that of the plastic used for the large bristles 4.

The melting point of the plastic of the bristles 3 of small section is of the order of 250° C., while the melting point of the plastic of the large bristles 4 is of the order of 180° C.

The bristles 3 of small section are advantageously made of nylon or polyester, while the bristles 4 of larger section are elastic and are made of relatively soft thermoplastic.

In an advantageous embodiment, the bristles 3 of small section are made of nylon and have a diameter of 8 hundredths of a millimeter, while the bristles 4 of larger section have a diameter of 30 hundredths of a millimeter.

Once the bristles of the brush 1 have been subjected to the action of shears, as indicated hereinbefore, the bristles 3 and 4, which then have substantially the same length, are exposed to a heat source 8 consisting of a bank of infrared radiation or a flame (or a bank of flames) disposed at an appropriate distance from the brush and extending substantially along the entire length of the core 2 parallel to this core.

The whole thing is adapted so that the bristles are exposed to the heat source in a substantially uniform manner over the entire periphery of the brush. To this end, a slow rotational movement about the axis of the core 2 is advantageously imparted to the brush 1, so that all of the ends of the bristles pass in front of the substantially linear heat source parallel to a generatrix of the brush.

When the brush has been subjected to the heat source for a sufficient period of time, the bristles of large section 4 become significantly shorter than the bristles 3 of smaller section, as illustrated in FIG. 2. Moreover, the ends of the bristles 3 display bulges 9 in the shape of a small ball, while the ends of the bristles 4 display larger bulges 10 in the shape of a mushroom head or a nail head.

By virtue of the combination of these characteristics, it is possible to obtain a brush 1 ensuring heavy charging with cosmetic product when it is withdrawn from the container containing the product. A brush of this kind gives strong, distinct make-up effects very different from those obtained with conventional brushes.

The heat treatment of the model brush with bristles 3 and 4 having substantially the same length can be effected with hot air. E.g. a current of hot air is advanced over all or part of the length of the brush, rotated about its axis. FIG. 3 shows a brush obtained under these conditions, only part 4 of this brush having been treated. In the treated part H, the bristles 4 of large section have a smaller length than the bristles 3 made of a plastic having a higher melting point. Contrary to the case of FIG. 2, the ends of the bristles 3 and 4 treated with hot air do not display a bulge. In the untreated part of the brush, the bristles 3 and 4 have substantially the same length.

FIG. 4 shows a brush having been subjected to treatment by infrared radiation or a flame, as in the case of FIG. 2, but only over part H of the length. The shorter bristles 4 provided with bulges 10 and the bristles 3 provided with balls 9 are situated in the part H. In the untreated part, the bristles 3 and 4 have substantially the same length.

FIG. 5*a*, 5*b* and 5*c* show, respectively, different cross-sectional shapes of a bristle according to the present invention and FIG. 6 illustrates the diameter measurement of a bristle.

I claim:

1. Brush intended for the application of a cosmetic product, comprising a plurality of bristles transversely implanted in an elongated core formed by turns of a twisted metal wire, said bristles being wedged between said turns, said bristles comprising bristles selected from at least two groups, namely a first group including bristles of relatively small cross-section, lieing in a circle having a diameter of between 6 and 13 hundredths of a millimeter, and a second group of bristles of larger cross-section lieing in a circle having a diameter larger than 13 hundredths of a millimeter and generally smaller than 30 hundredths of a millimeter, said bristles of each group extending in a radial direction relative to said core, the bristles of small cross-section having a greater length in the radial direction than the bristles of large cross-section, over at least part of the brush, characterised in that the bristles of small cross-section are made of a thermoplastic having a higher melting point than the melting point of a thermoplastic elastomer from which the bristles of large cross-section are made, the melting point of a thermoplastic of the bristles of small section being of the order of 230° to 280° C., while the melting point of the thermoplastic elastomer of the bristles of larger cross-section is of the order of 150° to 230° C.

2. Brush according to claim 1, characterised in that the difference between the melting point of the thermoplastic of the bristles (3) of small cross-section and that of the bristles (4) of large cross-section is of the order of 50° C.

3. Brush according to claim 1 or claim 2, characterised in that the ends of the bristles of small cross-section (3) and the ends of the bristles of large cross-section (4) are bulge (9, 10).

4. Brush according to claim 3, characterised in that the ends of the bristles of small cross-section (3) are in the shape of a small ball, while the ends of the bristles of larger cross-section (4) have a flatter shape and a larger diameter.

5. Brush according to claim 1, characterised in that the number of bristles per turn is between 7 and 55.

6. Brush according to claim 1, characterised in that the proportion of bristles of large cross-section relative to the bristles of small cross-section is between $\frac{1}{4}$ and 4/1.

7. Brush according to claim 1, characterised in that the bristles of a material selected from the group consisting of small cross-section (3) are made of nylon or polyester, while the bristles of larger cross-section (4) are made of a relatively soft thermoplastic and a soft thermoplastic elastomer.

8. Brush according to claim 1, characterised in that the bristles of smaller cross-section (3) have a shape selected from the group consisting of a solid cross-section, hollow circular cross section and a cross-section having at least one capillary groove.

* * * * *